US007234968B2

(12) United States Patent
Lottmann et al.

(10) Patent No.: US 7,234,968 B2
(45) Date of Patent: Jun. 26, 2007

(54) POWER DISTRIBUTION FUSEHOLDER

(75) Inventors: Todd F. Lottmann, Washington, MO (US); Daniel B. Giblin, Ballwin, MO (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 11/267,964

(22) Filed: Nov. 7, 2005

(65) Prior Publication Data

US 2007/0105455 A1 May 10, 2007

(51) Int. Cl.
*H01R 13/66* (2006.01)

(52) U.S. Cl. ..... 439/620; 439/771; 439/810; 337/186

(58) Field of Classification Search ..... 439/620–622, 439/771, 810; 337/186
See application file for complete search history.

(56) References Cited

U.S. PATENT DOCUMENTS 5,618,209 A * 4/1997 Lin et al. ..... 439/621
6,793,534 B2 * 9/2004 Cheng et al. ..... 439/621

OTHER PUBLICATIONS

"Fuse Holders with BD (Box Distribution) Connectors", Marathon Special Products Catalog, page 33.

* cited by examiner

*Primary Examiner*—Truc Nguyen
(74) *Attorney, Agent, or Firm*—King & Spalding LLP

(57) ABSTRACT

A fuseholder with a power distribution terminal for providing simultaneous fused connections to multiple devices.

21 Claims, 2 Drawing Sheets

POWER DISTRIBUTION FUSEHOLDER

BACKGROUND OF THE INVENTION

This invention relates generally to generally to circuit protection devices, and more particularly to fuseholders for connecting overcurrent protection fuses to electrical circuitry.

Electrical systems typically include a number of circuit protection devices that protect electrical circuitry, equipment, and components from damage. Overcurrent protection devices, for example, are constructed to physically open or interrupt a circuit path and isolate electrical components from damage upon the occurrence of specified overcurrent conditions in the circuit. Known circuit protection devices include devices such as fuses, circuit breakers, and limiters, which may address overcurrent, overload, and short circuit conditions in an electrical system, and other switching devices. As the size and complexity of electrical systems increase, the number of associated circuit protection devices also typically increases.

Typically, circuit protection devices, such as fuses, are interconnected to electrical circuitry using a combination of terminal blocks, sometimes referred to as power distribution blocks, and fuseholders. The terminal blocks provide for electrical connection to power receiving devices, sometimes referred to as loads, while the fuseholders provide for connection of the fuses to power supply devices. The fuseholders are commonly wired to the terminal blocks to provide fused protection of the load side electrical connections, circuitry, and associated devices.

DETAILED DESCRIPTION OF THE INVENTION

Figure 1:
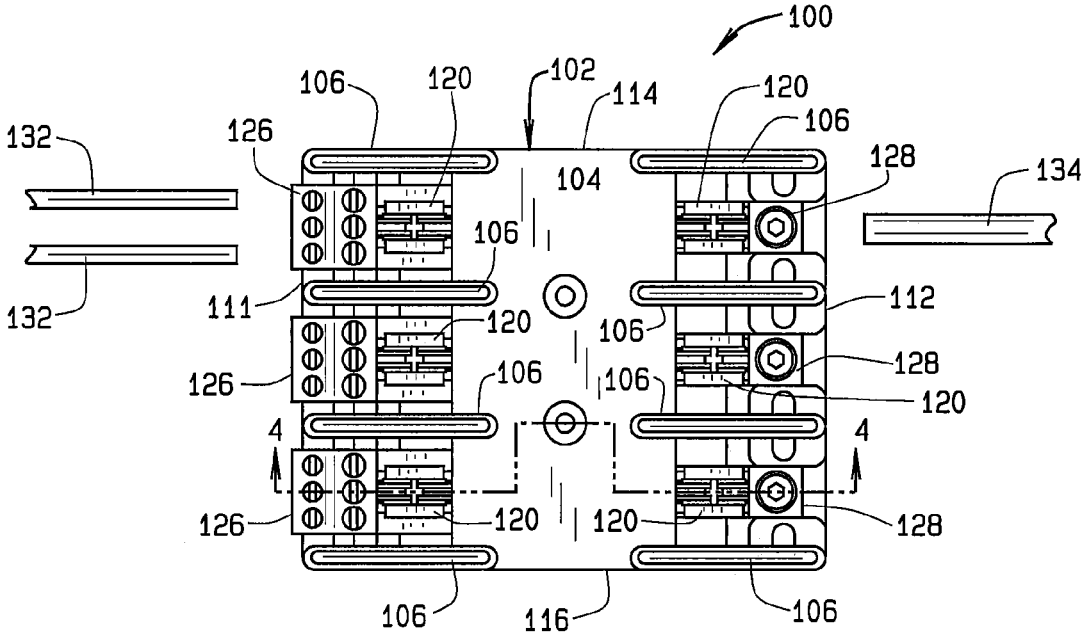
FIG. 1 is a top plan view of an exemplary fuseholder according to the present invention.
Figure 2:
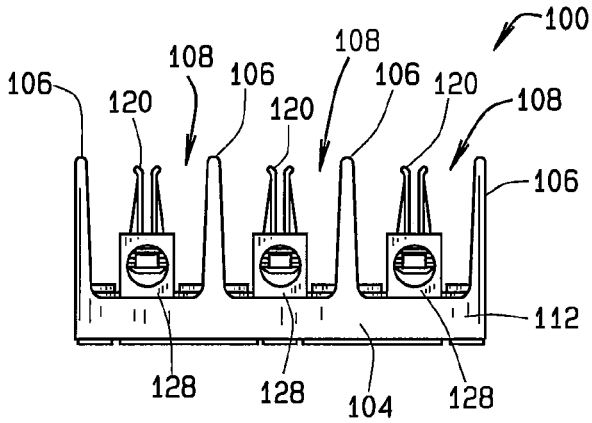
FIG. 2 is a first end elevational view of the fuseholder shown in FIG. 1.
Figure 3:
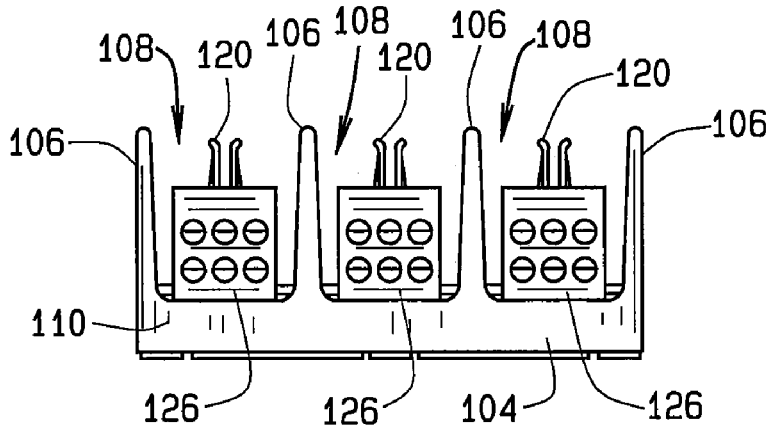
FIG. 3 is a second end elevational view of the fuseholder shown in FIG. 1.
Figure 4:
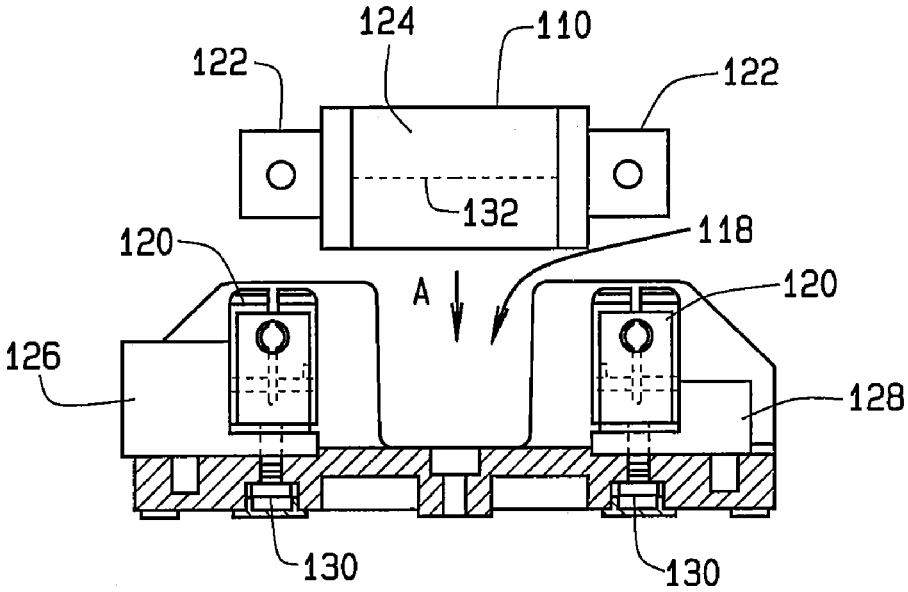
FIG. 4 is a cross sectional view of the fuseholder shown in FIG. 1 taken along line 4—4.

FIG. 1 is a top plan view, FIGS. 2 and 3 are end elevational views, and FIG. 4 is an exemplary cross sectional view of an exemplary embodiment of a fuseholder 100 according to the present invention.

As shown in the Figures, the fuseholder 100 may include a nonconductive or insulating housing 102 having a substantially flat base 104, and a plurality of upstanding side walls 106 extending upwardly from the base 104 and defining fuse compartment or receptacles 108 therebetween. In an illustrative embodiment, the base 104 and the walls 106 are fabricated from thermoplastic materials and are formed integrally into a unitary or one-piece construction according to, for example, known molding techniques. In other embodiments, however, the housing base and the walls may be fabricated from other materials including but not limited to thermoset and ceramic materials, and the housing base and walls may be formed in a multiple piece modular construction and assembled together for use in an electrical system.

The housing 102 and the receptacles 108 are each dimensioned to accommodate an overcurrent protection fuse 110 (FIG. 4), and may, for example, be open and accessible from above the housing 102 to facilitate insertion and removal of the fuses 110 and also may be open and accessible from the sides of the housing 102 to facilitate connection to external circuitry. In an illustrative embodiment, the housing 102 includes three fuse receptacles 108 and is sometimes referred to as a multiple pole fuseholder. Varying numbers of receptacles 108 may be provided in different embodiments of the invention, and the receptacles 108 may be differently dimensioned to accommodate varying types of fuses. In still another embodiment, the housing 102 may include a single fuse receptacle 108, sometimes referred to as a single pole fuseholder.

The housing base 104 may be generally rectangular in an exemplary embodiment and includes opposing end edges 111 and 112, and opposing side edges 114, 116 interconnecting the end edges 111, 112. The upstanding walls 106 extend upwardly and substantially perpendicularly from the base 104, and extend from the respective end edges 111, 112 in a direction parallel to the side edges 114, 116 and toward a central portion of the base 104. The walls 106 are spaced from one another along the end edges 111, 112 by a predetermined distance to accommodate fuses 110 therebetween. As also seen in the Figures, in one example the upstanding walls 106 do not extend from the end 111 of the base 104 to the end 112, but rather may include a cutout or opening 118 (best seen in FIG. 4) therebetween that provides access to fuses 110 and/or the receptacles 108 for insertion and removal of the fuses 110. In another embodiment, the walls 106 may extend end-to-end on the base 104.

Conductive fuse contacts 120 are coupled to the base 104 and extend upwardly therefrom. The fuse contacts 120 are arranged in pairs within each receptacle 108 and are located a distance from one another in each receptacle 108 that corresponds to the fuse 110 intended to be received therein. The fuse contacts 120 may be centered between adjacent walls 106 in the housing 102, and in an exemplary embodiment, the fuse contacts 120 may be resiliently deflectable spring clips that engage and retain conductive elements of a fuse in a known manner. As one example, the fuse clips may engage and retain knife blade contacts 122 extending from a generally cylindrical body 124 of the fuse 110 as shown in FIG. 4 as the fuse 110 is inserted downwardly toward the fuse contacts 120 in the direction of arrow A. Alternatively, the fuse contacts 120 may receive and retain conductive end caps or ferrules of a fuse, or still other fuse contacts known in the art may be used to establish electrical connection to conductive portions of the fuse and complete an electrical circuit through the fuse. Additionally, while the fuseholder 100 is illustrated for use with cylindrical fuses 110, sometimes referred to as cartridge fuses, it is understood that the inventive concepts described herein could be applied to fuseholders for other types of fuses, including but not limited to rectangular fuse modules and the like.

Conductive terminal elements 126, 128 are connected to the fuse contacts 120 at the end of each fuse receptacle 108, and like the fuse contacts 120 are arranged in pairs within each receptacle 108 and are accessible from above and from the sides in the receptacles 108. As best shown in FIG. 4, in one embodiment, the terminal elements 126, 128 are separately fabricated from and coupled to the respective fuse contacts 120 via a threaded fastener 130 and are held mechanically and electrically to one another with surface-to-surface engagement. It is recognized, however, that other means of connecting the terminal elements 126, 128 are known and may be used in alternative embodiments, including but not limited to the use of rivets, welding, staking and brazing techniques to join the terminal elements 126, 128 and the fuse contacts 120. Still further, the terminal elements 126, 128 may be unitarily or integrally formed with the respective fuse contacts 120 in another embodiment as desired.

For purposes of illustration, the terminal elements 128 may be considered line side terminals that establish a conductive path and electrical connection to the respective fuse contacts 120 that, in turn, provide electrical connection to the fuses 110. Similarly, the terminal elements 126 may be considered load side terminals that establish a conductive path and electrical connection to the respective fuse contacts 120 that, in turn, provide electrical connection to the fuses 110. One line side terminal 128 and one load side terminal 126 are provided in each fuse receptacle 108, and the line side and load side terminals 126, 128 are situated on opposing ends of the receptacles 108 adjacent the fuse contacts 120. The upstanding walls 106 prevent inadvertent shorting of adjacent fuse contacts 120 and terminal elements 126, 128 on the respective ends 111, 112 of the housing. That is, adjacent fuse contacts 120 and terminal elements 126, 128 at the respective ends 111, 112 of the housing 102 are separated from one another by the walls 106.

When connected to external circuitry as described below, current may flow from a power supply device, sometimes referred to as a line device, through the line side terminal 128 and associated fuse contact 120 to the fuse 110. In a known manner, the fuse 110 provides overcurrent protection via a fusible link 132 that is constructed to melt, disintegrate, open or otherwise structurally fail upon an occurrence of a predetermined current condition flowing through the fuse 110. In use, current may flow through the fusible link 132 and through the opposing fuse contact 120 and associated load side terminal 126 to a power receiving device, sometimes referred to as a load device. The fuse 110, via the fusible link 132, opens the circuit between the line side terminal 128 and the load side terminal 126 to protect the load side devices and associated circuitry from current that may otherwise cause damage. A variety of fuse links and fuse element assemblies are known for such purposes, and will not be described in detail herein.

In the exemplary embodiment shown in the Figures, the load side terminals 126 are constructed to receive and engage load multiple load wires 132 (two of which are shown in FIG. 1) at the same time to establish the load side connections. The line side terminals 128, however, are constructed to receive a single line wire to establish the load side connection. As depicted in the Figures, the load side terminals 126 are multi-lug wire box terminals having numerous openings that receive and connect to the load wires 132 in a known manner and in multiple positions or locations with respect to each terminal 126. The depicted line side terminals 128 are single lug wire box terminals that receive and connect to the respective line wire 134 in a single position with respect to the terminals 128. While exemplary wire lug terminals 126, 128 are illustrated in the Figures, it is understood that other types of terminals may likewise be used in other embodiments of the invention as desired.

Therefore, by using a single lug line terminal 128 at one end of each receptacle 108, and multi-lug load terminals 126 at the opposing end of each of the fuse receptacles 108, each line wire 134 may feed more than one load wire 132. Stated another way, for each power supply device connected to one of the receptacles 108 in the fuseholder 100 via a line wire 134, fused power may be fed to multiple load devices via the connecting load wires 132 coupled to the load terminal 126. The load terminals 126 are therefore sometimes referred to as power distribution terminals because they provide for multiple current paths in each terminal that facilitates simultaneous interconnection of multiple devices to a single fuse 110 in one or more of the fuse receptacles 108. Considering that the housing 102 may accommodate multiple fuses 110, many devices may be conveniently connected via the wires 132 and 134 to provide desired fuse protection to an electrical system.

The fuseholder 100 therefore combines the function of a conventional fuseholder with the function of a conventional terminal block, and eliminates the need for conventional terminal blocks or power distribution blocks. Costs associated with obtaining and installing terminal blocks may be saved, and separate wiring of the terminal block may be eliminated. Fused protection may therefore provided at lower cost with a faster installation time than has conventionally been possible.

While the invention has thus far been described in terms of the load side terminals 126 connecting to a plurality of load devices and the line side terminal 128 connecting to a single power supply, it is contemplated that the connection of the fuseholder 100 may be reversed if desired. That is, the terminals 126 may connected to a plurality of power supply devices via the wires 132, and the terminals 128 may be connected to a single load via the wires 134. Such connection may be particularly advantageous, for example, when multiple power supply batteries are used to feed a single load.

One embodiment of a fuseholder is described herein. The fuseholder includes an insulative housing dimensioned to accommodate at least one overcurrent protection fuse; first and second conductive fuse contacts coupled to the housing and arranged to establish an electrical connection through the fuse; a conductive line side terminal extending from the first fuse clip; and a conductive load side terminal extending from the second fuse clip; wherein at least one of the line side terminal and the load side terminal is a power distribution terminal configured for connection to more than one wire at the same time.

Optionally, at least one of the first and second contacts may be a fuse clip, and the housing may include a base. A third fuse contact may be provided and at least one upstanding partition wall may extend from the base and separate the third fuse contact from one of the first and second fuse contacts. The power distribution terminal may be a multi-lug wire terminal configured to accept and retain first and second wires in different respective positions. The housing may define a fuse receptacle, and the receptacle may be open and accessible from above and from opposing sides of the base. The walls may define an access opening for insertion and removal of a fuse. The first and second fuse contacts may be fastened to a surface of the respective line side and load side terminals, and the housing may be configured to accommodate a cartridge fuse.

Another exemplary embodiment of a multi-pole fuseholder is also described. The fuseholder may include a unitary insulative housing dimensioned to accommodate a plurality of overcurrent protection fuses; respective pairs of conductive fuse contacts coupled to the housing and corresponding to the plurality of fuses; and respective pairs of conductive line side and load side terminals associated with each of the pairs of fuse contacts and corresponding to the plurality of fuses, wherein at least one of the pairs of conductive line side and load side terminals includes a terminal configured for connection to a plurality of wires, thereby providing multiple current paths to the terminal for distributing power associated with one of the fuses.

Yet another embodiment of a fuseholder is described. The fuseholder includes an insulative housing comprising a base and upstanding walls defining a plurality of open ended fuse receptacles, the fuse receptacles being accessible from above the base and accessible from opposing sides of the base, and each fuse receptacle dimensioned to accommodate a cylindrical cartridge fuse for providing overcurrent protection to a circuit. Respective pairs of conductive fuse clips are coupled to the housing in each receptacle, and a wire connecting terminal is coupled to each fuse clip and accessible in each receptacle from above the base and at each opposing side of the base to establish one of a line side and a load connection to the fuse holder. Adjacent pairs of fuse clips and associated terminals are separated from one another by one of the upstanding walls, and at least one of the fuse receptacles comprises a single wire lug terminal at one side of the receptacle and a multi-lug wire terminal at an opposing side of the receptacle.

Still another embodiment of a fuseholder is described including compartment means for receiving at least one overcurrent protection fuse, line side means for establishing electrical connection to the at least one fuse, the line side means engaging and retaining the overcurrent protection fuse and connected to the compartment means, load side means for establishing electrical connection to the at least one fuse, the load side means engaging and retaining the overcurrent protection fuse and connected to the compartment means, line side means for connecting the means for establishing to power supply circuitry, and load side means for connecting the means for establishing to load circuitry. The line side means and the load side means for connecting are positioned on the compartment means and extend from the respective line side means and load side means, and at least one of the line side means and the load side means provides for simultaneous connection to multiple wires.

While the invention has been described in terms of various specific embodiments, those skilled in the art will recognize that the invention can be practiced with modification within the spirit and scope of the claims.

What is claimed is:

1. A fuseholder comprising:

an insulative housing dimensioned to accommodate an overcurrent protection fuse;

first and second conductive fuse contacts coupled to the housing and arranged to establish an electrical connection through the fuse;

a conductive line side terminal extending from the first fuse contact; and a conductive load side terminal extending from the second fuse contact;

wherein at least one of the line side terminal and the load side terminal is a power distribution terminal configured for connection to more than one wire at the same time, and wherein overcurrent protection is simultaneously provided in each of the wires by a single fuse.

2. The fuseholder of claim 1, wherein at least one of the first and second contacts comprises a fuse clip.

3. The fuseholder of claim 1, wherein the housing comprises a base and the fuseholder comprises a third fuse contact, the housing further comprising at least one upstanding partition wall extending from the base and separating the third fuse contact from one of the first and second fuse contacts.

4. The fuseholder of claim 1, wherein the power distribution terminal comprises a multi-lug wire terminal configured to accept and retain first and second wires in different respective positions.

5. The fuseholder of claim 1, wherein one of the line side and load side terminals comprises a lug wire terminal configured to accept and retain a single wire.

6. The fuseholder of claim 1, wherein the housing comprises a base and upstanding walls defining a fuse receptacle, the receptacle being open and accessible from above and from opposing sides of the base.

7. The fuseholder of claim 1, wherein the first and second fuse contacts are fastened to a surface of the respective line side and load side terminals.

8. The fuseholder of claim 1, wherein the housing comprises a base and upstanding side walls, at least one of the side walls defining an access opening for insertion and removal of a fuse.

9. The fuseholder of claim 1, wherein the housing is configured to accommodate a cartridge fuse.

10. A multi-pole fuseholder comprising:

a unitary insulative housing dimensioned to accommodate a plurality of overcurrent protection fuses;

respective pairs of conductive fuse contacts coupled to the housing, each of the pairs corresponding to only one of the plurality of fuses; and respective pairs of conductive line side and load side terminals associated with each of the pairs of fuse contacts and each pair of conductive line side and load side terminals corresponding to only one of the plurality of fuses, wherein at least one of the pairs of conductive line side and load side terminals includes a terminal configured for connection to a plurality of wires, thereby providing multiple current paths to the terminal for distributing power associated with one of the fuses.

11. The fuseholder of claim 10, wherein the fuse contacts comprise fuse clips.

12. The fuseholder of claim 10, wherein the housing comprises at least one partition wall separating adjacent line side and load side terminals.

13. The fuseholder of claim 10, wherein at least one pair of the line side and load side terminals comprises a multi-lug wire terminal configured to accept and retain first and second wires in different respective positions.

14. The fuseholder of claim 13, wherein the other of the line side and load side contacts in the at least one pair comprises a lug wire terminal configured to accept and retain only a single wire.

15. The fuseholder of claim 10 wherein the fuse contacts are separately fabricated from and fastened to the respective line side and load side terminals.

16. The fuseholder of claim 10, wherein the housing comprises a base and upstanding walls, at least one the upstanding walls defining an access opening for insertion and removal of a fuse.

17. A fuseholder comprising:

an insulative housing comprising a base and upstanding walls defining a plurality of open ended fuse receptacles, the fuse receptacles being accessible from above the base and accessible from opposing sides of the base, each fuse receptacle dimensioned to accommodate a cylindrical cartridge fuse for providing overcurrent protection to a circuit;

respective pairs of conductive fuse clips coupled to the housing in each receptacle;

a wire connecting terminal coupled to each fuse clip and accessible in each receptacle from above the base and at each opposing side of the base to establish one of a line side and a load connection to the fuse holder;

wherein, adjacent pairs of fuse clips and associated terminals are separated from one another by one of the upstanding walls; and wherein the terminals in at least one of the fuse receptacles comprises a single wire lug terminal at one side of the receptacle and a multi-lug wire terminal at an opposing side of the receptacle.

18. The fuseholder of claim 17, wherein the terminals are arranged in pairs in each respective receptacle, one of the terminals in each pair comprising a single lug wire terminal and the other of the terminals in each pair comprises a multi-lug wire terminal.

19. The fuseholder of claim 17 wherein the fuse contacts are separately fabricated from and fastened to the respective terminals.

20. The fuseholder of claim 17, wherein the upstanding walls define central access openings for insertion and removal of a fuse in each receptacle.

21. A fuseholder comprising:

compartment means for receiving at least one overcurrent protection fuse;

line side means for establishing electrical connection to the at least one fuse, the line side means engaging and retaining the overcurrent protection fuse and connected to the compartment means;

load side means for establishing electrical connection to the at least one fuse, the load side means engaging and retaining the overcurrent protection fuse and connected to the compartment means;

line side means for connecting the means for establishing electrical connection to power supply circuitry; and load side means for connecting the means for establishing electrical connection to load circuitry;

wherein the line side means and the load side means for connecting are positioned on the compartment means and extend from the respective line side means and load side means, and at least one of the line side means and the load side means for connecting provides for simultaneous connection to multiple wires, thereby providing overcurrent protection to the multiple wires with a single fuse connected to the load side means.

* * * * *

US007234968C1

(12) EX PARTE REEXAMINATION CERTIFICATE (10040th)

United States Patent
Lottmann et al.

(10) Number: US 7,234,968 C1
(45) Certificate Issued: Feb. 12, 2014

(54) POWDER DISTRIBUTION FUSEHOLDER

(75) Inventors: Todd F. Lottmann, Washington, MO (US); Daniel B. Giblin, Ballwin, MO (US)

(73) Assignee: Cooper Technologies Company, Houston, TX (US)

Reexamination Request:
No. 90/012,508, Nov. 2, 2012

Reexamination Certificate for:

| | |
|---|---|
| Patent No.: | **7,234,968** |
| Issued: | **Jun. 26, 2007** |
| Appl. No.: | **11/267,964** |
| Filed: | **Nov. 7, 2005** |

(51) Int. Cl.
*H01R 13/66* (2006.01)

(52) U.S. Cl.
USPC ..... 337/186; 439/620.01; 439/771; 439/810

(58) Field of Classification Search
None
See application file for complete search history.

(56) References Cited

To view the complete listing of prior art documents cited during the proceeding for Reexamination Control Number 90/012,508, please refer to the USPTO's public Patent Application Information Retrieval (PAIR) system under the Display References tab.

*Primary Examiner* — Yuzhen Ge

(57) ABSTRACT

A fuseholder with a power distribution terminal for providing simultaneous fused connections to multiple devices.

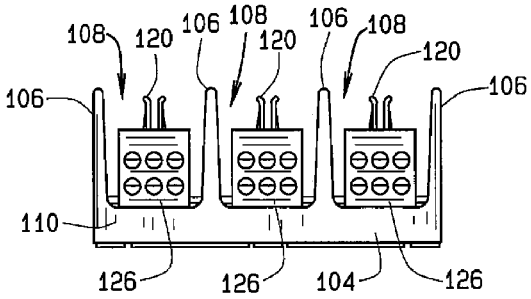

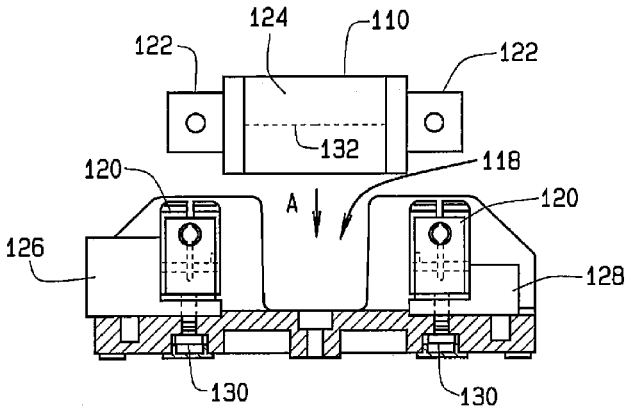

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-21 are cancelled.

* * * * *